United States Patent [19]

Davis

[11] Patent Number: 4,798,042

[45] Date of Patent: Jan. 17, 1989

[54] ARTICLE BAGGER

[76] Inventor: Robert Davis, 7305 Woodbine Avenue, Unit #519, Markham, Ontario, Canada, L3R 3V7

[21] Appl. No.: 116,898

[22] Filed: Nov. 5, 1987

[51] Int. Cl.[4] ..... B65B 43/36; B65B 43/44; B65B 43/62; B65B 39/02

[52] U.S. Cl. ..... 53/572; 53/573; 53/385

[58] Field of Search ..... 53/572, 573, 385, 386, 53/571, 261, 257

[56] References Cited

U.S. PATENT DOCUMENTS

| | | | |
|---|---|---|---|
| 3,138,907 | 6/1964 | Gerbe | 53/385 |
| 3,197,936 | 8/1965 | Messmer | 53/385 X |
| 3,206,913 | 9/1965 | Fleigher et al. | 53/572 |
| 3,707,826 | 1/1973 | Cole | 53/572 X |
| 3,789,570 | 2/1974 | Mullins, Jr. | 53/572 X |
| 4,124,966 | 11/1978 | Wilson | 53/572 X |
| 4,172,349 | 10/1979 | Lipes | 53/572 X |
| 4,198,800 | 4/1980 | Wilson | 53/573 X |
| 4,370,845 | 2/1983 | Perolls et al. | 53/572 |
| 4,541,228 | 9/1985 | Petersen | 53/572 |

FOREIGN PATENT DOCUMENTS

| | | | |
|---|---|---|---|
| 2003443 | 3/1979 | United Kingdom | 53/572 |

*Primary Examiner*—Horace M. Culver

[57] ABSTRACT

The present invention provides a machine for bagging a plurality of small items in a single bag. The machine comprises a bag support for holding a plurality of flattened open topped bags stacked against one another in an upright position, a pneumatic bag opener for blowing down into and opening the bags individually at the bag support, a bag stretcher for stretching the opening of the bags, a feed chute for feeding the articles to the stretched opened bags, a gripper for gripping on the bags after feeding and pulling them sideways from the bag support to a bag closure applicator.

5 Claims, 7 Drawing Sheets

FIG.1.
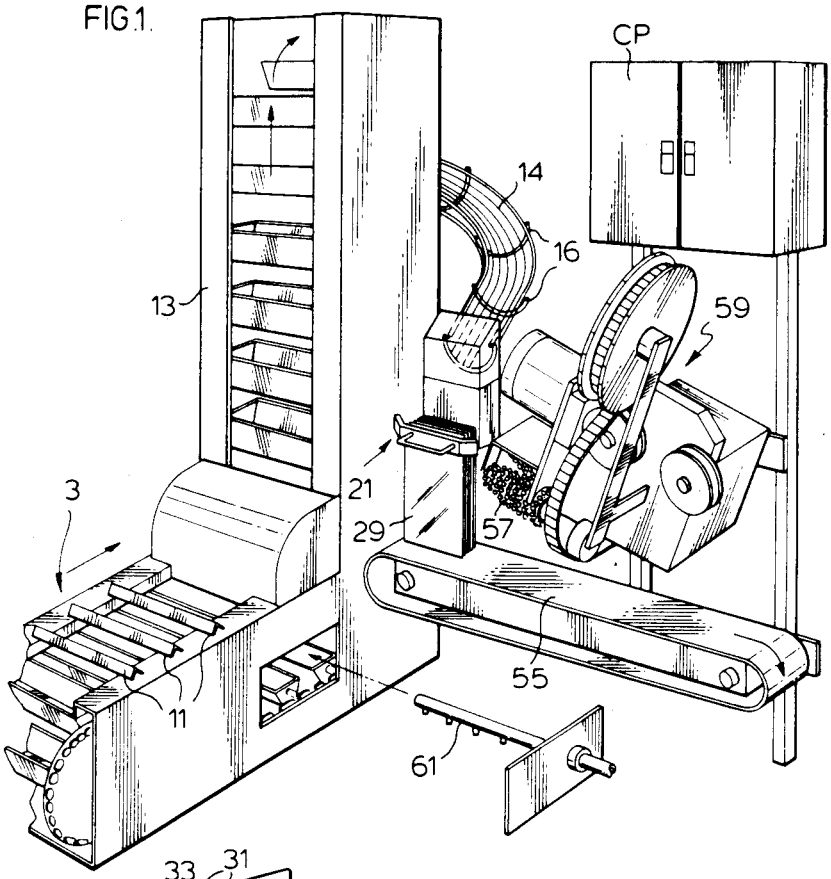
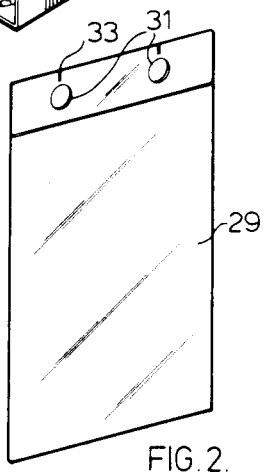
FIG. 2.
FIG. 3.
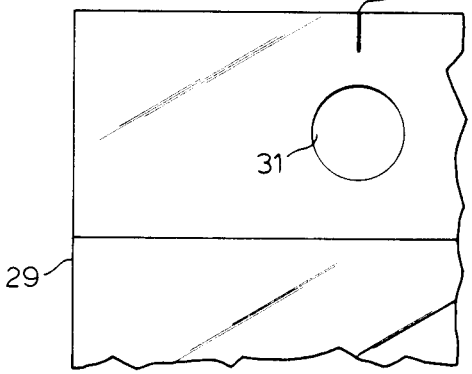

ARTICLE BAGGER

FIELD OF THE INVENTION

The present invention relates to an article bagging machine particularly designed for the bagging of individual portioned creamer cups.

BACKGROUND OF THE INVENTION

In the creamer cup industry, where individual portions of cream are contained in a single small cup, these cups, according to standard practice, are bulk packages in cardboard boxes. This is both an awkward as well as an expensive method of packaging the individual cups.

Many other small products are bulk packaged in cardboard boxes in the manner described above and therefore there is a need for a replacement, inexpensive and convenient method of bulk packaging small articles.

SUMMARY OF THE PRESENT INVENTION

The present invention comprises a packaging machine which, rather than using cardboard boxes, uses plastic bags, i.e. a bagging machine. The bagging machine of the present invention comprises a bag support for holding a plurality of flattened opened topped bags stacked against one another in an upright position, a bag opener for opening the bags individually at the bag support, a bag stretcher for stretching the opening of the bags, feed means for feeding the articles to be packaged to the stretched opened bags, gripping means for gripping the bags after feeding and for pulling them sideways off of the bag support and preferably to a bag closure applicator for closing the tops of the bags.

BRIEF DESCRIPTION OF THE DRAWINGS

The above as well as further advantages and features of the present invention will be described in greater detail according to the preferred embodiment of the present invention in which:

FIG. 1 is a perspective view of a bagging machine according to a preferred embodiment of the present invention;

FIG. 2 is a perspective view of one of the bags used in the machine of FIG. 1;

FIG. 3 is a front view of the upper corner mounting area of the bag of FIG. 2;

DETAILED DESCRIPTION ACCORDING TO THE PREFERRED EMBODIMENTS OF THE PRESENT INVENTION

Figure 4:
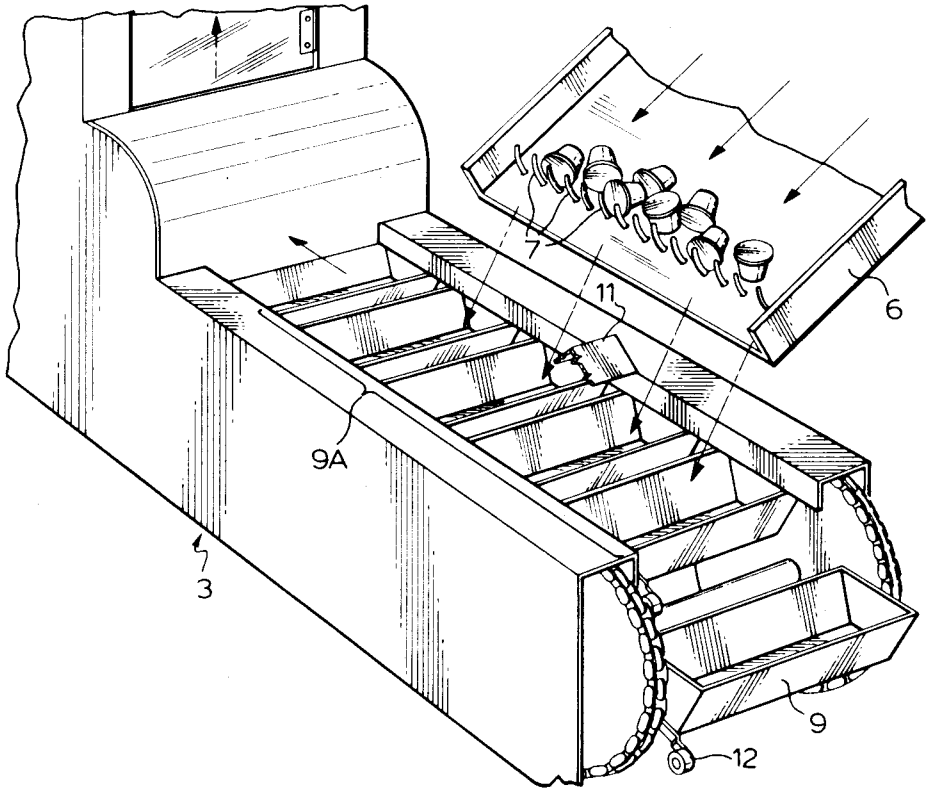
FIG. 4 is a perspective view of an indexer used in combination with the bagging machine of FIG. 1 according to a further preferred embodiment of the present invention.

FIG. 1 shows a bagging machine generally indicated at 1. FIG. 4 shows an indexing machine generally indicated at 3. The present invention in its broadest aspect relates to the bagging machine. However, a further aspect of the present invention incorporates the combination of the indexing and bagging machines to form a unitary indexing and bagging machine.

Figure 5:
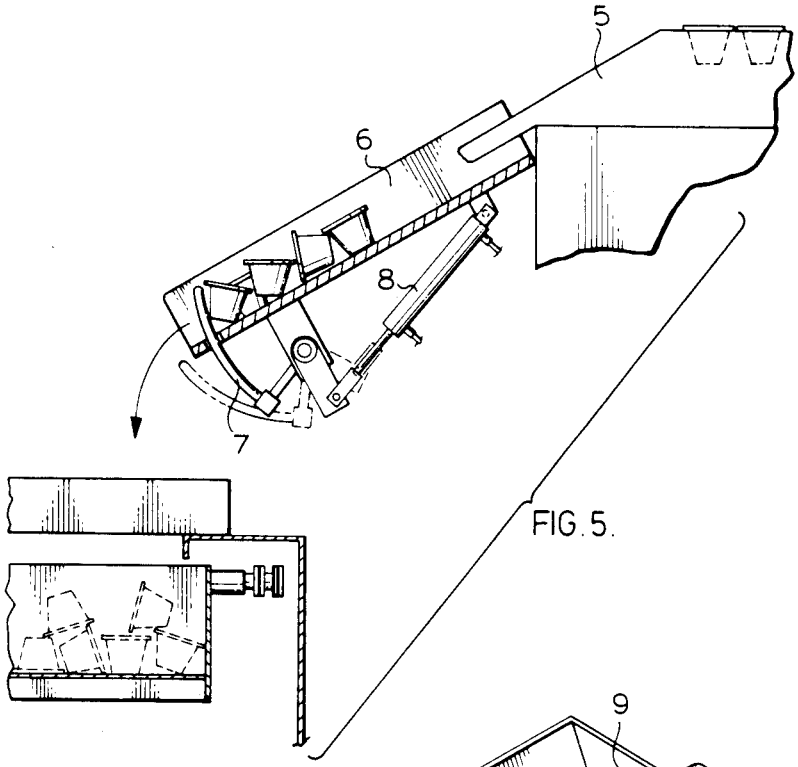
FIGS. 5 is a side view showing the indexer of FIG. 4 in operation.

In light of the above, reference is first had to FIGS. 4 and 5 of the drawings where the indexer comprises an upper collector 5 fed from a large supply of individual articles and in this case single serving coffee or creamer cups. The collector operates in a conventional manner to index a specified number of the cups which are then collected on a collector tray 6. This collector tray includes a movable claw-like stop 7 which sits in the stop position seen in FIG. 4 until the specified number of cups have been collected on the tray. At that point the claw is retracted by control piston 8 as seen in FIG. 5 so that the cups drop into collector baskets 9. These collector baskets are set up in groups such as group 9*a* to receive the indexed number of cups which will then be used for a single bag filling. A series of V-shaped deflector bars 11 also seen in FIG. 4 are provided for an even distribution of the cups between the baskets in group 9*a*.

All the baskets are pivotally mounted to a drive system and in this particular case a chain drive as seen in FIGS. 1 and 4 of the drawings. Each group of baskets, after having picked up its quota of cups moves from the indexing region 3 in the direction of the arrows shown in FIG. 1 up a tower 13. As the individual baskets clear over the top of the tower they are deflected by means of deflectors 12 provided on each of the baskets and catching on the tower causing them to dump their loads onto a downwardly twisting chute 14. The lower end of this chute, best seen in FIGS. 7 and 8 of the drawings, feeds directly to a bag preset to receive the cups as described later in detail.

The chute itself is designed for maximum efficiency and cleanliness. More particularly, it is formed by a plurality of spaced apart rounded ribs or rails 15 secured at spaced junctures by brackets 16. This arrangement minimizes friction between the cups and the chute and provides an automatic drainage of liquid spilling from any damaged cups that might otherwise pass down the chute. In other words, the drainage occurs directly through rather than down the chute and does not spill into the bag.

Figure 7:
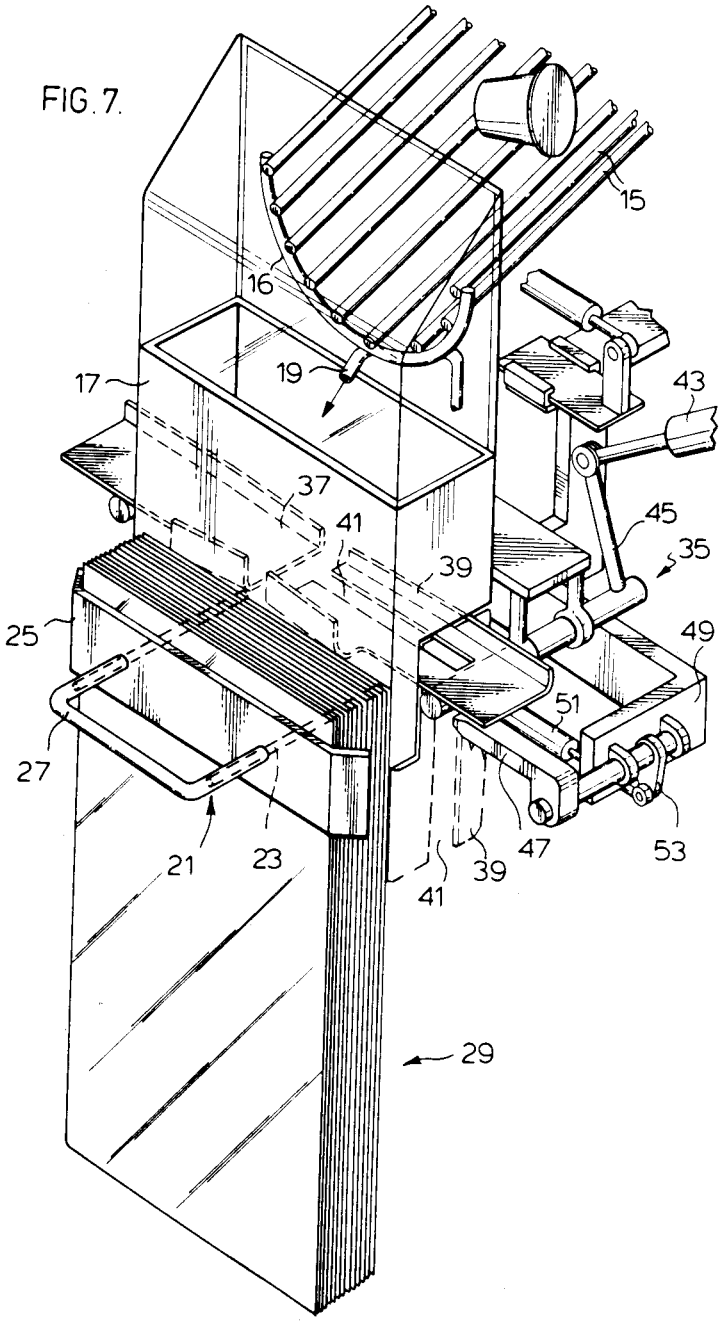
FIG. 7 is an enlarged perspective view of the bag mounting and filling region of the machine of FIG. 1.

Chute 15 feeds down into a collector or funnel 17, the front wall of which is provided with a bag support, known in the trade as a wicket plate, generally indicated at 21 in FIGS. 1 and 7. Also directed down into the collector is an air nozzle 19.

Bag support or wicket plate 21 comprises a pair of prong-like members 23 for receiving a plurality of stacked bags or wicketed 29. These bags, best seen in FIGS. 2 and 3 of the drawings, are provided at their upper ends with a pair of openings 31 on the lengthened back panel of the bags for fitting over the prong-like members 23. Here it should be noted that the mouth of each bag, although pressed tightly together is not sealed shut which allows opening of the bag by means such as a suction cup or a pneumatic bag opener again to be described later in detail. Also note that the back panel of the bag is provided with a downward slit 33 directly above each of the openings 31. The function of these will also be described later in detail.

After a number of the bags have been placed over prong-like members 23 a weighted guard and bag guide 25 having a handle 27 is fitted over and covers the prongs. This weighted guide tends to push the bags inwardly towards collector 17 wherein the most inwardly positioned bag, i.e. the bag to the front of the stack, is exposed to compressed air blown out from nozzle 19 to open that particular bag. The timing of the operation is such that the bag is opened prior to the feeding of the cups from the chute.

Figure 8:
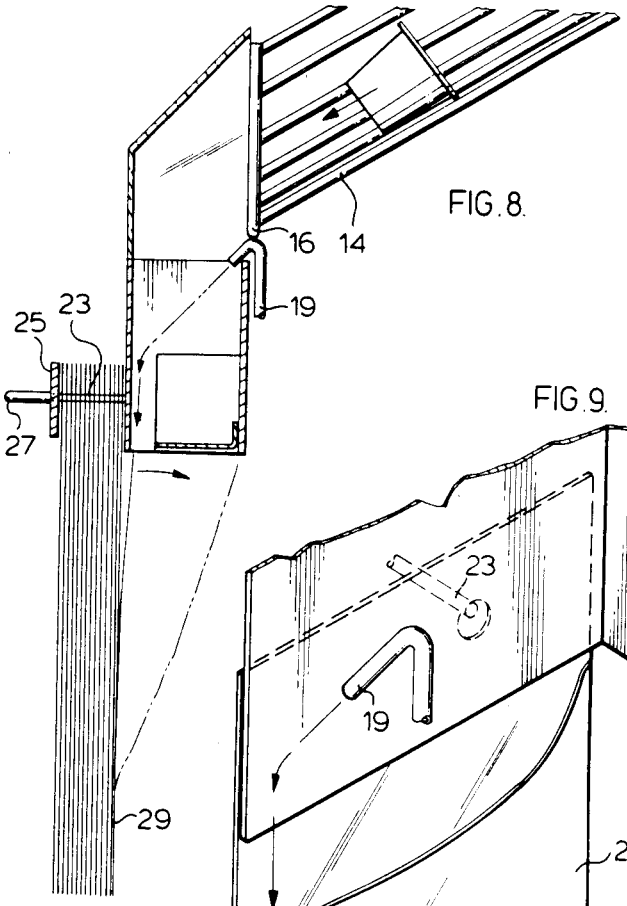
FIG. 8 is a side view of the bag mounting region of FIG. 1.
Figure 9:
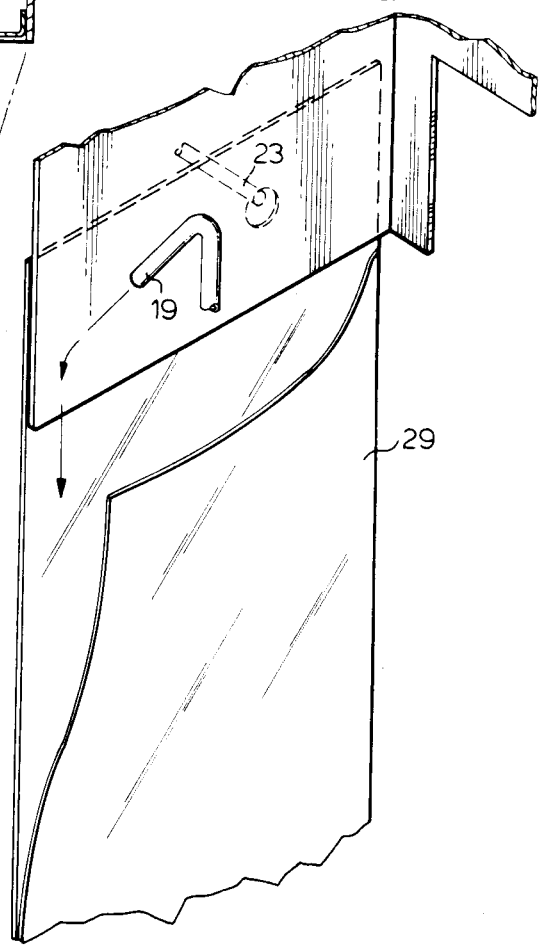
FIG. 9 shows the fitting of a bag to the bag mounting region of FIG. 8.
Figure 10:
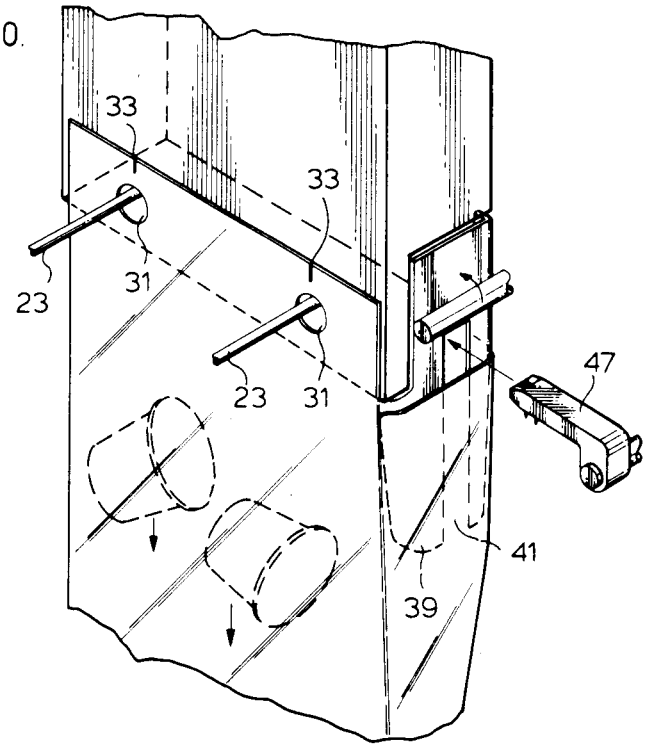
FIG. 10 shows the stretching and filling of one of the bags as fitted to the bag mounting region shown in FIG. 8.
Figure 11:
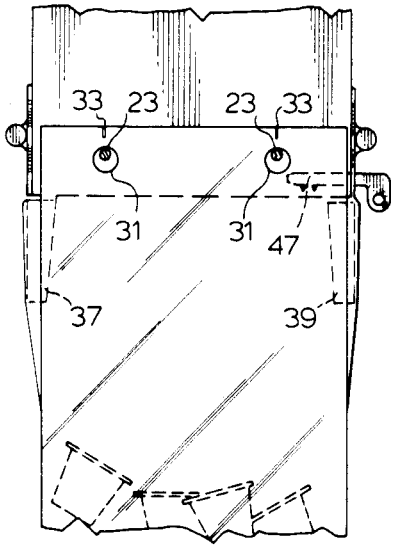
FIGS. 11 and 12 are front views showing in sequence the gripping and pulling of the bag from the bag mounting region after filling as per FIG. 10.
Figure 12:
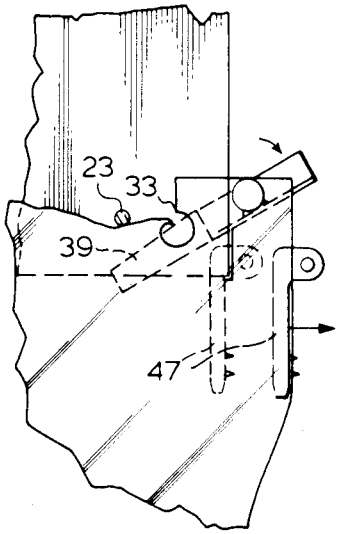

The complete opening of each bag is done with more than just the compressed air which provides an initial separation of the bag mouth as best seen in FIG. 8 of the drawings. Here it will be noted that the bag is actually formed whereby the front panel of the bag is lower than the back supporting panel of the bag allowing the front panel to be blown into the dotted line position in FIG. 8 without affecting any of the bags in the rear of the stack, i.e. the back panel on the bag acts as a deflector to guide the opening of the front panel and to prevent an air flow from nozzle 19 past the most forward bag in the stack. After the bag has been initially opened by the air flow as shown in FIG. 8, it is then further stretched open by means of a stretcher assembly, generally indicated at 35, the components of which can be well seen in FIG. 7 in perspective and the operation of which is best shown in FIGS. 10 through 12 of the drawings. More particularly, the stretcher assembly comprises a pair of pivotal flaps 37 and 39 which are adjustable in spacing between one another according to the bag size. These flaps are in the up position as shown in FIG. 7 during the initial blow opening of the bag and which then pivot to the down position as shown in FIG. 10 for a wide open stretching of the bag. They not only act as guide members to ensure proper feed from chute 14 into the stretched open bag but also in the case of a relatively light load, such as creamer cups, provide support or hold the bag from above without any assist from beneath the bag.

The actual pivoting or up/down movement of flaps 37 and 39 is controlled by means of a lever assembly comprising pivotally coupled piston 43 and arm 45 which move the two flaps and in particular flap 39 as shown in FIG. 12 of the drawings. Note that the two flaps have a downward tapering which eases their fitting into and out of the bag.

After the supply of cups has been fed down into the bag it is then pulled off the stretcher assembly by a finger like gripper 47 mounted to a sliding carriage 49. Gripper 47 slides in an up position horizontally with carriage 49 as shown in FIG. 10 of the drawings directly through slot 41 of flap 39 still in its down position. The gripper, once reaching its FIG. 11 position, is then pivoted downwardly to a vertical extending position by piston 51 and pivot mount 53 seen in FIG. 7 to grip on and actually pierce the bag as shown in FIG. 12 of the drawings. The slide carriage with the gripper remaining in the down position is then moved away from the bag support area pulling the upper part of the bag off of the bag support at which point the lower heavy part of the bag then drops down onto and is carried by conveyor 55. Again, having reference to FIG. 12 it will be seen that as the finger gripper pulls the upper end of the bag, flap 37 is timed to move back to its up position as does flap 39 allowing the bag to clear past the two flaps.

As earlier described, each of the bags is suported by fitting prong-like members 23 through holes 31 on the taller back panel of the bag. As also described, the bag is weakened at 33 directly in line with each of the holes. This weakening does not affect the bags ability to support itself, but does provide a tear region which gives way with the added force applied to the bag by means of gripper 47. With this arrangement, as can be seen in FIG. 13 of the drawings, the bag is simply pulled off of prongs 23 giving way at 33 without leaving any part of the bag on the bag support and therefore not interfering with the next bag to be presented for filling.

Figure 13:
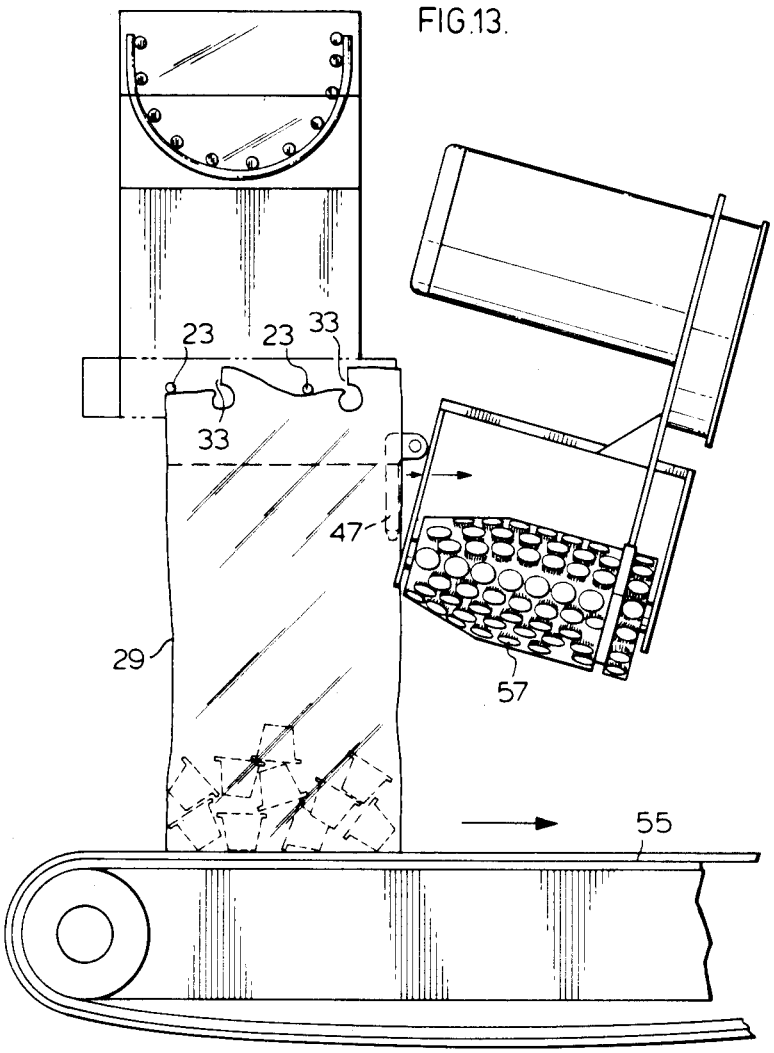
FIG. 13 is a further front view showing movement of the full bag to the applicator for applying the closure to the top of the bag.
Figure 14:
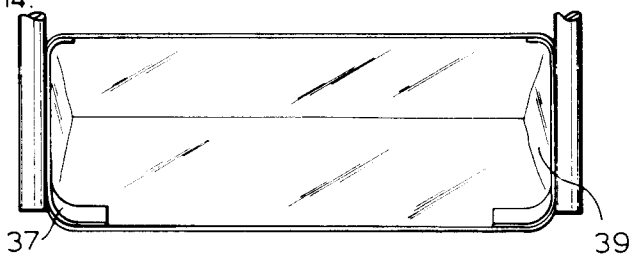
FIG. 14 is a top view looking down into a stretched open bag as per FIG. 10.

The bag being pulled away as shown in FIG. 13 is carried by the gripper and the conveyor to a pair of rotating brushes 57, shown in both FIGS. 1 and 13 of the drawings. These brushes which are bristled for handling the bag rotate in opposite direction, i.e. towards one another, and are angled so as to both collapse the neck of the bag and to assist conveyor 55 in passing the bag along to a closure applicator 59. Each of the brushes has a frustoconical end region providing a gap between the brushes for initial insertion of the bag between the brushes and the brushes themselves are adjustable in position to provide the required amount of pressure on the bag depending on its weight for carrying it to the closure applicator.

As will be appreciated, many different kinds of closure applicators can be used with the particular applicator being shown comprising a KWIK LOK TM applicator for securing about the neck of the bag which, as described above, has been precollapsed or bunched by brushes 57 specifically for the application of the closure.

The timing of all of the components including the opening and feed to the bag, the pulling or removal of the bag from the bag support and the transporting of the bag to the closure applicator is controlled through control panel CP as seen in FIG. 1 of the drawings.

Figure 6:
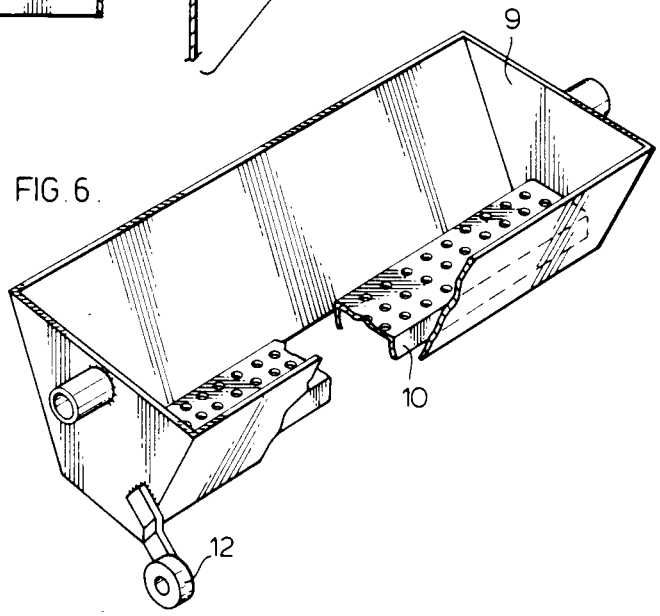
FIG. 6 is top perspective view of a carrying tray used in the bagging machine of FIG. 1.

As earlier described, chute 14 is designed for automatic draining in the event of inadvertant spillage from the cups. As a further cleaning feature of the machine, each of the baskets 9 for carrying the cups to the feed chute has a perforated bottom 10 as shown in FIG. 6 of the drawings. This perforated bottom not only provides a self draining feature, but also allows cleaning of the empty baskets by a spray bar 61 as seen in FIG. 1 of the drawings positioned to clean the baskets prior to returning to the pick-up point from the cup indexer.

Two particularly unique features of the present invention are the spreading and supporting of the bag by the bag stretcher and the sideways pulling of the bag from the bag support. With respect to the first feature, this substantially reduces complications by not having to provide some type of timed moving surface beneath the bag as it is being loaded. With respect to the second feature, the sideways as opposed to forward or rearward removal of the bag from the bag support, eliminates the bag material on and fouling of the inner ends of the prongs on the bag support.

It will now be seen how the present invention provides a simple yet efficient means for bagging milk cups using inexpensive yet easily handled plastic bags. It will be further appreciated that this bagging technique can equally as well be used with other typically small articles. Further, although various preferred embodiments of the invention have been described in detail, it will be understood that variations can be made to those embodiments without departing from the spirit of the invention or the scope of the appended claims.

The embodiments of the invention in which an exclusive property or privilege is claimed are defined as follows:

1. A bagging machine comprising a bag support supporting a plurality of open topped bags stacked upright against one another, a bag opener for initiating opening of the bags individually at said bag support, a pair of flaps movable between an up and a down position, said flaps when in the down position fitting interiorly of and stretching the opening of the bags, feed means vertically feeding the articles to the stretched opened bags with said flaps providing both an article feed guide and sole support for the bags while being fed with such articles, a bag puller at one of said flaps only, bag puller control means for fitting said bag puller to a gripping position interiorly of the bags with said flaps in said down position, flap control means to move said flaps to the up position as said bag puller control means operates said bag puller to pull said bags sideways off of said bagging machine.

2. A bagging machine as claimed in claim 1, wherein said one of said flaps is provided with a slot which opens downwardly when said one of said flaps is in said down position, said puller comprising a finger-like gripper which slides horizontally through said slot and then pivots downwardly to fit interiorly of and grip on said bags while said one of said flaps remains in said down position.

3. A bagging machine as claimed in claim 2, wherein said gripper is provided with bag piercing means to maximize gripping and sideways pulling of the bags off of said bagging machine.

4. A bagging machine as claimed in claim 1, wherein said flaps having a downward tapering and assist said bag opener for a full opening of the bags.

5. A bagging set up comprising a bagging machine, including a pair of prong bag supports and a plurality of bags having weakened top panels fitted to said bag support, and bagging machine further including a bag opener for initiating opening of the bags individually at said bag support, first and second flaps movable between and up and a down position, said flaps being tapered inwardly downwardly to assist said bag opener in completing opening of said bags and said flaps when in the down position fitting interiorly of and stretching the opening of said bags, said bags being hung vertically from said bag support, feed means for a vertical gravity feeding of articles of said stretched opened bags, said flaps providing both an article feed guide and a stretching support supporting entirely on their own weight of the bags both during and after feeding with such articles, a bag puller with bag puller control means at said first flap, said bag puller control means operating said bag puller to fit interiorly of said bags to a bag gripping position while said bags remain supported by said flaps, means for moving said flaps to said up position as said bag puller control means operates said bag puller to pull on and tear said bags at said weakened top panels off of said bag support sideways to a bag closure device.

* * * * *